United States Patent [19]

Threatt

[11] 4,064,576

[45] Dec. 27, 1977

[54] COMBINED BABY BOTTLE HOLDER AND MATTRESS COVER

[76] Inventor: Grace J. Threatt, Rte. 1 Box 17104, Colonial Heights, Va. 23834

[21] Appl. No.: 767,101

[22] Filed: Feb. 9, 1977

[51] Int. Cl.[2] ..... A47G 9/00; A47D 15/00

[52] U.S. Cl. ..... 5/334 C; D6/264; 248/103; 297/188

[58] Field of Search ..... 5/327, 335; 248/102, 248/105; D6/264, 270; 297/188–189

[56] References Cited

U.S. PATENT DOCUMENTS

| | | | |
|---|---|---|---|
| 1,934,615 | 11/1933 | Selverstone | 297/188 |
| 2,325,097 | 7/1943 | Behringer | 5/334 C |
| 2,526,121 | 10/1950 | Curry et al. | 248/102 |
| 2,586,153 | 2/1952 | Eisman | D6/269 |
| 3,060,462 | 10/1962 | Miller | 5/334 C |

*Primary Examiner*—Paul R. Gilliam
*Assistant Examiner*—Victor N. Sakran
*Attorney, Agent, or Firm*—Norman B. Rainer

[57] ABSTRACT

A bottle holder-mattress cover fabricated of absorbent fabric and having a pouch-like configuration is provided with a face portion containing two pockets, each adapted to snugly confine a baby bottle, and containing wedge means capable of positioning said bottle at a downward angle. The rear portion of the mattress cover contains tensioning means adapted to draw the cover tightly against a section of a mattress disposed within the pouch.

3 Claims, 3 Drawing Figures

COMBINED BABY BOTTLE HOLDER AND MATTRESS COVER

BACKGROUND OF THE INVENTION

This invention relates to a holder for a baby bottle as used by infants, and more particularly to a holder for a baby bottle useful in an infant's crib and adapted to function additionally as a protective cover for the mattress of said crib.

Infants who are still young enough to be bottle-fed are often given their bottles while in their cribs, and must drink from the bottle while unattended. The infant will generally be lying on his back or side, and may lack the ability to use his hands effectively to properly position the bottle. Not only must the bottle be brought to the infant's mouth, but it must be at an inclined angle to facilitate gravity flow of the contents into the mouth of the infant.

Although bottle-positioning devices for crib use have been disclosed such as those in U.S. Pat. Nos. 2,040,757, 2,415,186, 2,991,030, 3,298,648 and 3,635,430, they are either ineffective or involve features capable of causing injury or accidents. It is accordingly an object of this invention to provide a bottle positioning device for use in an infant's crib. It is another object to provide a bottle-positioning device free of features capable of causing injury or accidents for use in an infant's crib, an amenable to easy cleaning for maintenance of sanitary conditions. Other objects and advantages will appear hereinafter.

SUMMARY OF THE INVENTION

The objects of the present invention are accomplished in general by providing a bottle holder structured as a mattress cover comprised of a soft absorbent fabric having a pouch-like configuration adapted to snugly fit over the end of a mattress. The mattress cover has a generally rectangular face portion, a rear portion, a top portion, and two opposed side portions, all said portions preferably being integral parts of a single piece of suitably contoured fabric. The face portion contains at least two pockets, the opening of which are spaced apart in opposed relationship and directed toward the side portions, each pocket containing associated therein a wedge memeber capable of raising the bottom of a baby bottle so that the front or nipple end of said bottle is pointed downwardly toward the center of the face portion of said matress cover. The rear portion of the mattress cover contains tensioning means extending parallel to said top portion and adapted to draw the mattress cover tightly against a mattress disposed within the pouch-like region of said mattress cover.

DETAILED DESCRIPTION OF THE INVENTION

Figure 1:
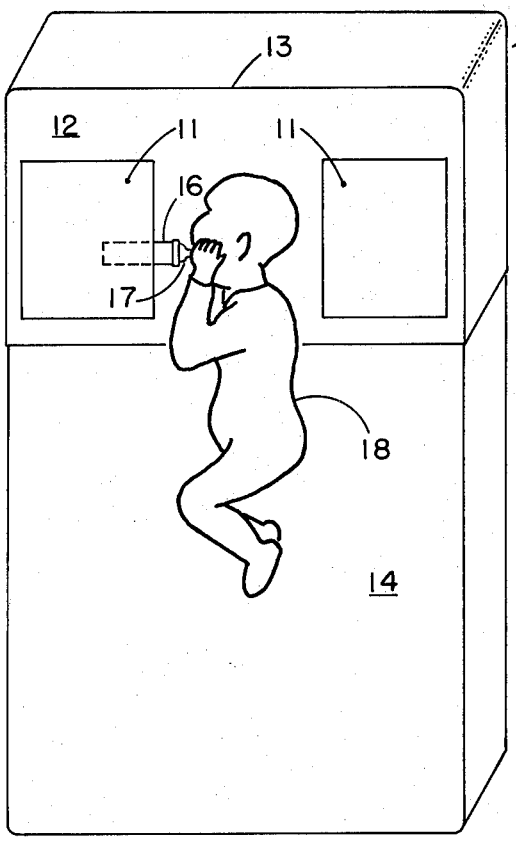
FIG. 1 is a perspective view showing the bottle holder of this invention engaged with the top portion of a mattress.

Referring to FIG. 1, opposed pockets 11 are mounted on the face portion 12 of bottle holder structure 10 positioned on the upper or head end 13 of mattress 14 located within a crib (not shown). A baby bottle 16 is positioned within one of the pockets 11 in a manner so as to make nipple 17 readily accessible to the infant 18 while tilting the bottle downwardly toward the infant.

Figure 2:
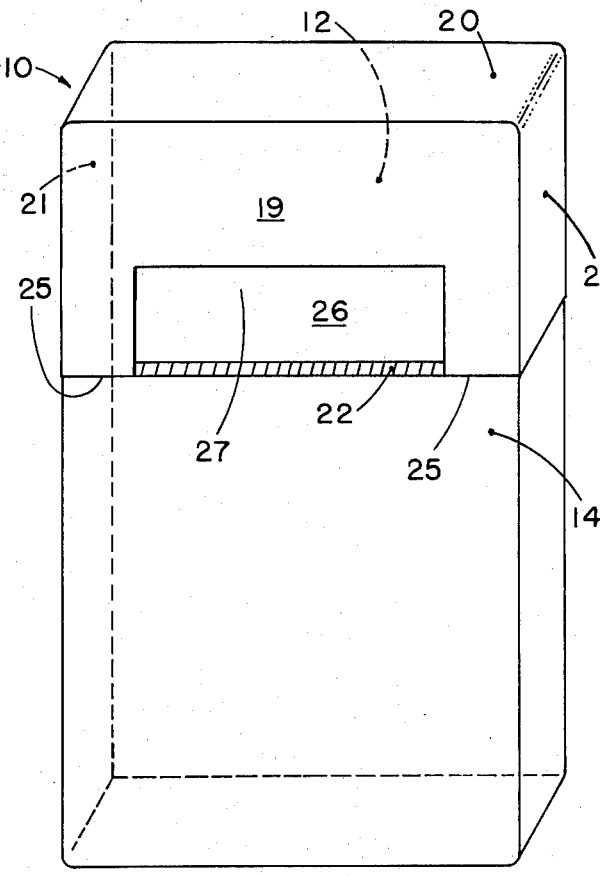
FIG. 2 is a perspective view of the rear of the bottle holder of FIG. 1.

The bottle holder structure 10 shown in FIG. 2 is seen to consist of rear portion 19, top portion 20, side portions 21, face portion 12 and a resilient elongated band 22 joined to discontinuous bottom edge 25 and serving as a tensioning means to draw side portions 21 tightly against mattress 14. The holder 10 is configured to define a pouch-like interior region 27. The upper and side portions may be continuous integral connective extensions of said face and rear portions, or said upper and side portions may be comprised of separate pieces of material joined to said face and rear portions as by sewing.

Figure 3:
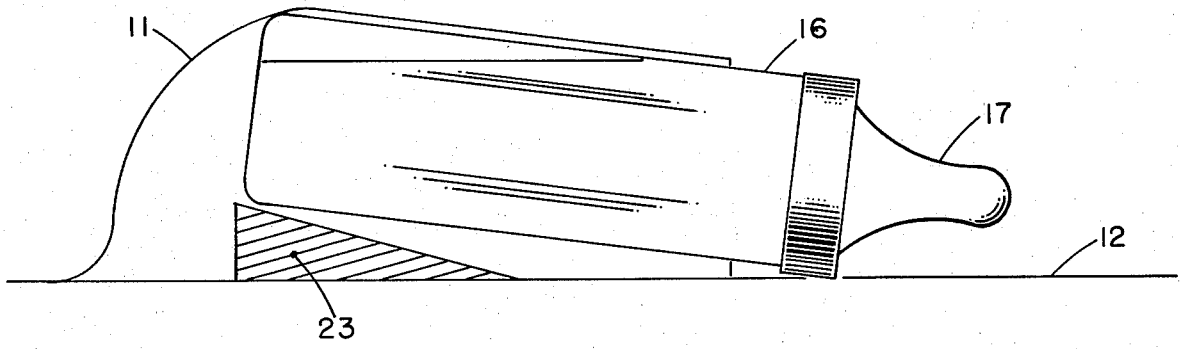
FIG. 3 is an enlarged longitudinal sectional view of a pocket of the bottle holder of FIG. 1 containing a positioning wedge and baby bottle.

Pocket 11, shown in enlarge section in FIG. 3, is attached to face portion 12 and contains wedge member 23 adapted to position bottle 16 at an incline of 15° to 30° with respect to face portion 12. The wedge members are preferably comprised of a soft material, either fabric or plastic, capable of surviving repeated launderings. Although the wedge member is preferably permanently attached to face portion 12 within pocket 11, some embodiments may be designed to be detachable to facilitate cleaning. The function of the wedge member is to support the bottom of a baby bottle in a somewhat elevated position. It's configuration may therefore be that of a classic wedge structure angled downwardly in the direction of the center of the mattress cover, or it may be simply an elevated member serving as a prop to support the bottom of the bottle. The wedge member may also have a saddle-like contour on its upper portion to accomodate and confine the baby bottle.

The bottle holding structure of this invention is made from an absorbent, easily washable woven, knitted or non-woven fabric comprised of fibers such as cotton, polyester, nylon, polyacrylic, polyolefin, and blends thereof. The fabric may have a light weight structure such as used in bed sheets, or may have a high loop texture as used in Turkish towels, and it may be capable of stretching at least 10% in all directions to accomodate and conform to the edges and corners of the underlying mattress. Suitable stretch may, for example, be provided by a tricot fabric construction and/or especially crimped or elastomeric yarns. The bottle holding structure also serves as a cover which protects the mattress and can be easily removed for washing.

The rear portion 19 contains a cut-out region 26 at the bottom thereof spanned by tensioning means 22 as shown in FIG. 2. The combined effect of the cut-out region and tensioning means is a critical feature of the present invention because it facilitates placement and removal of the bottle holder-mattress cover, and insures tight conformation about the underlying mattress. Because the bottle holder is caused to have a tight face portion free of folds, there is considerably less liklihood of suffocation of an infant or skin irritation caused by chafing against a fabric fold. The tensioning means is preferably comprised of elastomeric material capable of withstanding repeated launderings.

The pockets 11 are comprised essentially of rectangular or U-shaped pieces of fabric which are sewn or otherwise bonded to face portion 12 on three sides, leaving an opening directed laterally toward the opposite side portion of the bottle holder structure. Each pocket is dimensioned so as to accomodate wedge member 23 and snugly engage bottle 16. The pockets are symmetrically disposed about a line of symmetry vertical to top portion 20 and running down the center of the bottle holder structure. The open mouth portions of the pockets are spaced between about 10 and 18 inches apart so that the infant's head can easily rest between them, and permitting the infant to accept the bottle from either pocket.

Having thus described my invention, what is claimed is:

1. A holder for a baby bottle comprising a pouch-like structure adapted to snugly fit over the end section of a mattress, said holder being fabricated of soft, absorbent fabric and comprising a generally rectangular face portion, a rear portion, top portion and two opposed side portions, said face portion being provided with at least two pockets each capable of snugly accomodating a baby bottle, the openings of said pockets being spaced apart in opposed relationship about a vertical line of symmetry of said holder, each pocket containing therein a wedge member capable of elevating the bottom of a baby bottle so that the front of said bottle is angled downwardly toward said line of symmetry, said rear portion containing tensioning means operative to draw said holder structure tightly against a mattress which may be disposed within the pouch-like interior of said holder.

2. A holder in accordance with claim 1 wherein said face portion, rear portion, top portion and side portions are all part of a single integral piece of fabric.

3. A holder in accordance with claim 1 wherein said wedges are capable of positioning a baby bottle at a downward angle of inclination of between about 15° and 30°.

* * * * *